US007520340B2

(12) United States Patent
Bunney

(10) Patent No.: US 7,520,340 B2
(45) Date of Patent: Apr. 21, 2009

(54) METHOD OF AVOIDING THE NEED FOR A SCRAPER RUN IN DRILL OUT OPERATIONS AND A DOWNHOLE DRILLING MOTOR ASSEMBLY

(76) Inventor: Larry R. Bunney, 10623 Hardisty Drive, Edmonton, Alberta (CA) T6A 3T8

( * ) Notice: Subject to any disclaimer, the term of this patent is extended or adjusted under 35 U.S.C. 154(b) by 0 days.

(21) Appl. No.: 11/297,956

(22) Filed: Dec. 9, 2005

(65) Prior Publication Data

US 2006/0124359 A1 Jun. 15, 2006

(51) Int. Cl.
*E21B 37/02* (2006.01)

(52) U.S. Cl. ..... 175/57; 175/325.5; 166/173

(58) Field of Classification Search ..... 175/57, 175/325.5; 166/173
See application file for complete search history.

(56) References Cited

U.S. PATENT DOCUMENTS

| | | | | |
|---|---|---|---|---|
| 2,250,912 | A * | 7/1941 | Hudson et al. | 175/99 |
| 2,602,515 | A * | 7/1952 | Baker et al. | 166/173 |
| 2,670,046 | A * | 2/1954 | Kinzbach | 166/173 |
| 2,693,239 | A * | 11/1954 | Emanuel | 166/173 |
| 2,836,251 | A * | 5/1958 | Claypool et al. | 166/173 |
| 2,845,129 | A * | 7/1958 | Baker | 166/173 |
| 3,031,016 | A * | 4/1962 | Conrad | 166/173 |
| 3,032,114 | A * | 5/1962 | Best | 166/173 |
| 3,326,294 | A * | 6/1967 | Neilson | 166/173 |
| 4,189,000 | A * | 2/1980 | Best | 166/173 |
| 4,291,764 | A | 9/1981 | Pampell | |
| 4,479,538 | A | 10/1984 | Coyle, Sr. | |
| 4,648,447 | A * | 3/1987 | Bishop et al. | 166/173 |
| 4,706,748 | A | 11/1987 | Harris | |
| 4,798,246 | A * | 1/1989 | Best | 166/311 |
| 5,819,353 | A * | 10/1998 | Armell et al. | 15/104.2 |
| 6,408,945 | B1 | 6/2002 | Telfer | |
| 6,484,802 | B1 | 11/2002 | McGarian et al. | |
| 6,546,581 | B1 | 4/2003 | Swietlik et al. | |
| 6,695,058 | B1 | 2/2004 | French | |
| 6,776,231 | B2 | 8/2004 | Allen | |
| 2005/0257934 | A1 * | 11/2005 | Baird | 166/380 |

FOREIGN PATENT DOCUMENTS

| | | |
|---|---|---|
| CA | 521 249 | 1/1956 |
| CA | 656 612 | 1/1963 |

OTHER PUBLICATIONS

Wenzel Downhole Tools LTD. "Rotatable Scraper" advertisement, available at least as early as 2004.

* cited by examiner

*Primary Examiner*—William P Neuder
(74) *Attorney, Agent, or Firm*—Davis & Bujold, P.L.L.C.

(57) ABSTRACT

A method of avoiding the need for a scraper run in drill out operations. The method involves the single step of incorporating a rotary scraper into the downhole drilling motor assembly in such a manner that the rotary scraper rotates with the drill bit and follows the drill bit to scrape debris from interior casing walls.

1 Claim, 4 Drawing Sheets

METHOD OF AVOIDING THE NEED FOR A SCRAPER RUN IN DRILL OUT OPERATIONS AND A DOWNHOLE DRILLING MOTOR ASSEMBLY

This application claims priority from Canadian Application Ser. No. 2,487,380 filed Dec. 10, 2004.

FIELD OF THE INVENTION

The present invention relates to a method of avoiding the need for a scraper run in drill out operations and a downhole drilling motor assembly which has been modified in accordance with the teachings of the present invention.

BACKGROUND OF THE INVENTION

Every downhole drilling motor assembly includes a drilling motor and a drill bit. Where a moineau-style motor, having a rotor and stator, is used; there is also provided a drive shaft and a bearing assembly. The drive shaft converts eccentric motion of the moineau-style motor to concentric rotation. The bearing assembly ensures that the transition from eccentric rotation to concentric rotation is smooth and does not adversely affect operation of the drill bit.

During drill out operations, cement and other foreign material is drilled out of well casing. When drilling, a layer of debris, is unavoidably left on the interior casing wall. This debris needs to be cleaned off so that various equipment, which is used in the casing bore, can be anchored or removed. A separate scraper run is, therefore, conducted, in which a casing scraper is used to scrape the interior casing wall bare of any debris.

SUMMARY OF THE INVENTION

According to the present invention there is provided a method of a method of avoiding the need for a scraper run in drill out operations. The method involves the single step of incorporating a rotary scraper into the downhole drilling motor assembly in such a manner that the rotary scraper rotates with the drill bit and follows the drill bit to scrape interior casing walls.

According to another aspect of the present invention there is provided a downhole drilling motor assembly, which includes a drill bit, a rotary scraper, and a drilling motor adapted to rotate the rotary scraper with drill bit, thereby scraping debris from interior casing walls.

According to a final aspect of the present invention there is provided a rotary scraper which can be incorporated into the above described downhole drilling motor assembly and used in accordance with the teachings of the method. The rotary scraper includes a tubular body having exterior surface and an interior surface. The interior surface defines a central mud flow bore. A plurality of scraper blades extend from the exterior surface of the body in a spiral pattern to ensure full contact with interior casing walls, when running in to or pulling out of a casing bore. Biasing springs underlie the scraper blades to bias the scraper blades radially outwardly from the body.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
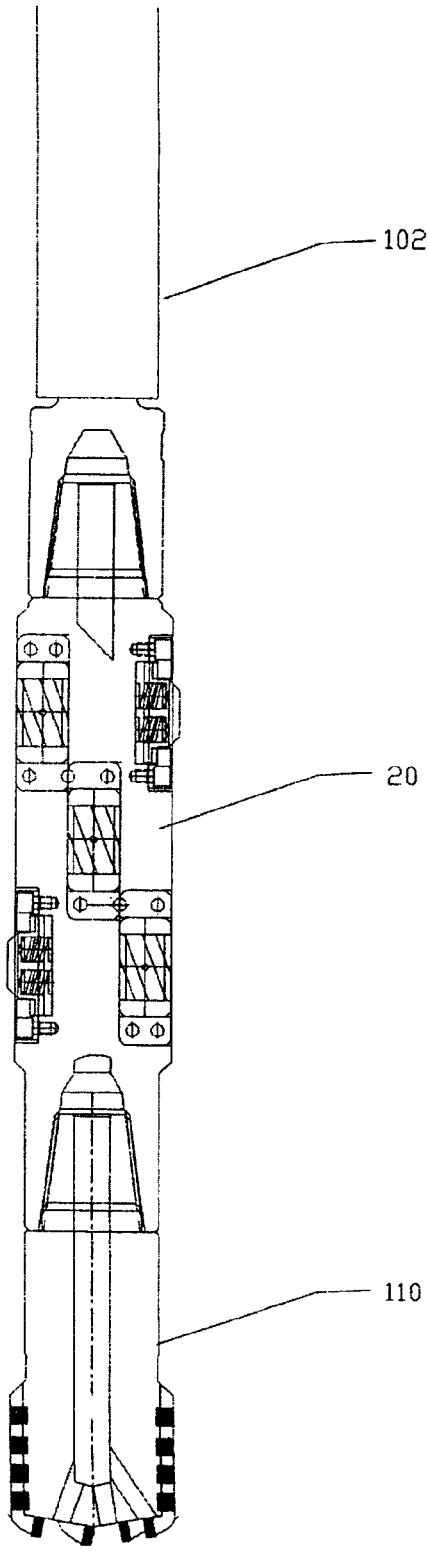
FIG. 1 is a side elevation view, in section, of a downhole drilling motor assembly constructed in accordance with the teachings of the present invention.

The preferred embodiment, a downhole drilling motor assembly generally identified by reference numeral 10, will now be described with reference to FIGS. 1 through 4.

Figure 4:
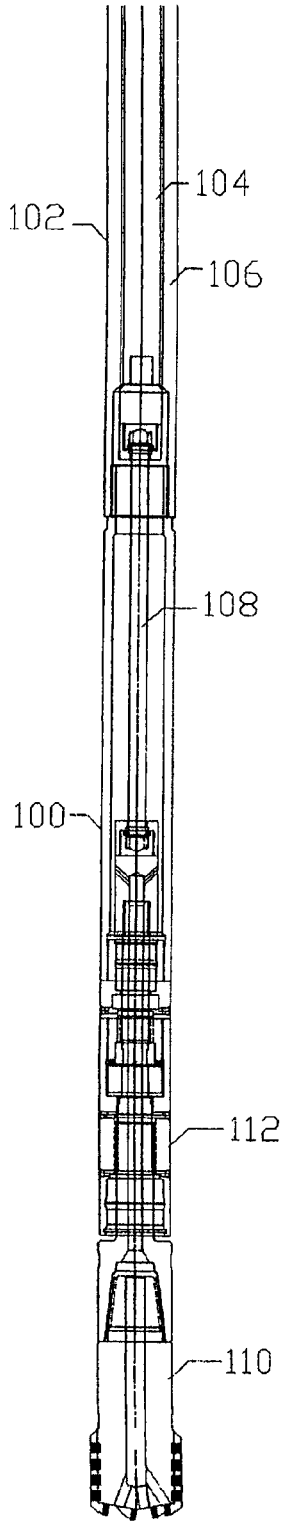
FIGURE 4 PRIOR ART
FIG. 4 labelled as PRIOR ART is a side elevation view, in section, of a downhole drilling motor assembly.

Description of Prior Art:

Referring to FIG. 4, there is illustrated a PRIOR ART downhole drilling motor assembly. This downhole drilling motor assembly, generally identified by reference numeral 100, is illustrated in order to place the present invention in context. Downhole drilling motor assembly 100 includes a motor section 102 having a rotor 104 and a stator 106. A drive shaft 108 is provided to convert eccentric motion of motor section 102 to concentric motion. A drill bit 110 is provided which is supported by bearing assembly 112, through which input from drive shaft 108 is transmitted to drill bit 110.

Structure and Relationship of Parts:

Referring to FIG. 1, downhole drilling motor assembly 10 differs from the prior art in that a rotary scraper 20 has been incorporated. The other identified components remain, and have been identified by the identical reference numerals used for FIG. 4. Rotary scraper 20 is rotated with drill bit 110 by motor section 102. Rotary scraper 20 follows drill bit 110, scraping debris from interior casing walls. With rotary scraper 20 following along behind drill bit 110, the need for a separate scraping run is avoided.

Figure 2:
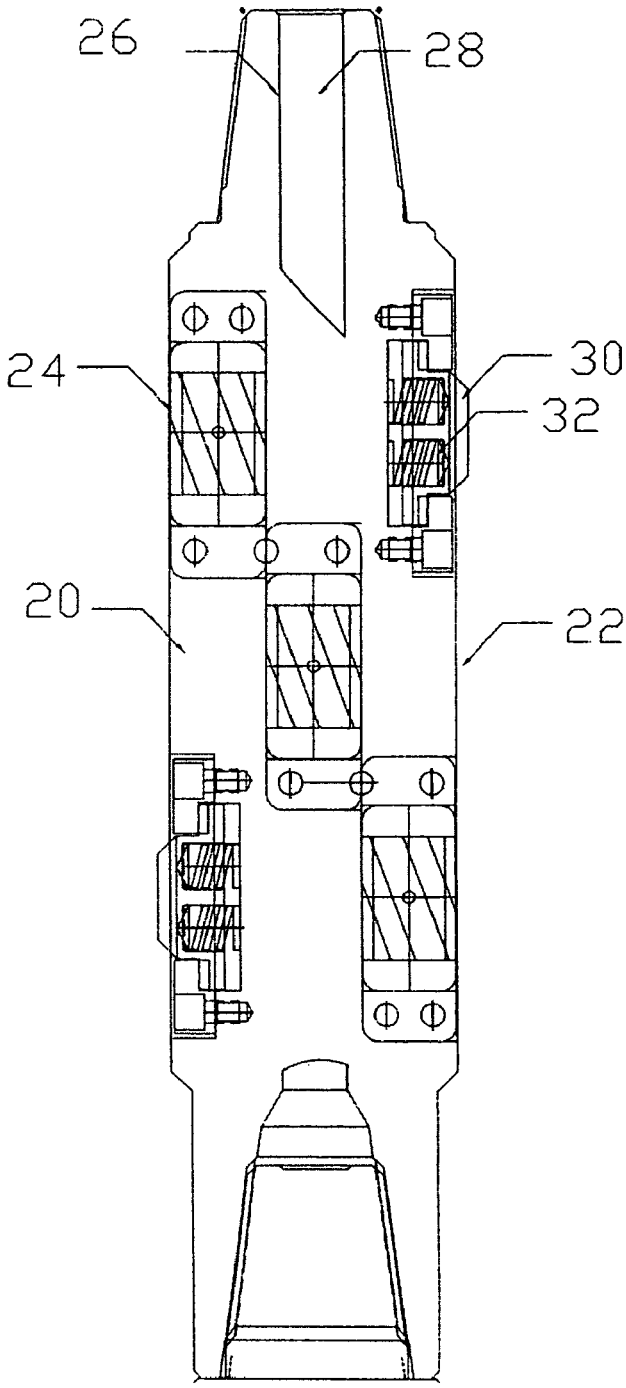
FIG. 2 is a side elevation view, in section, of the rotary scraper, incorporated into the downhole drilling motor assembly.
Figure 3:
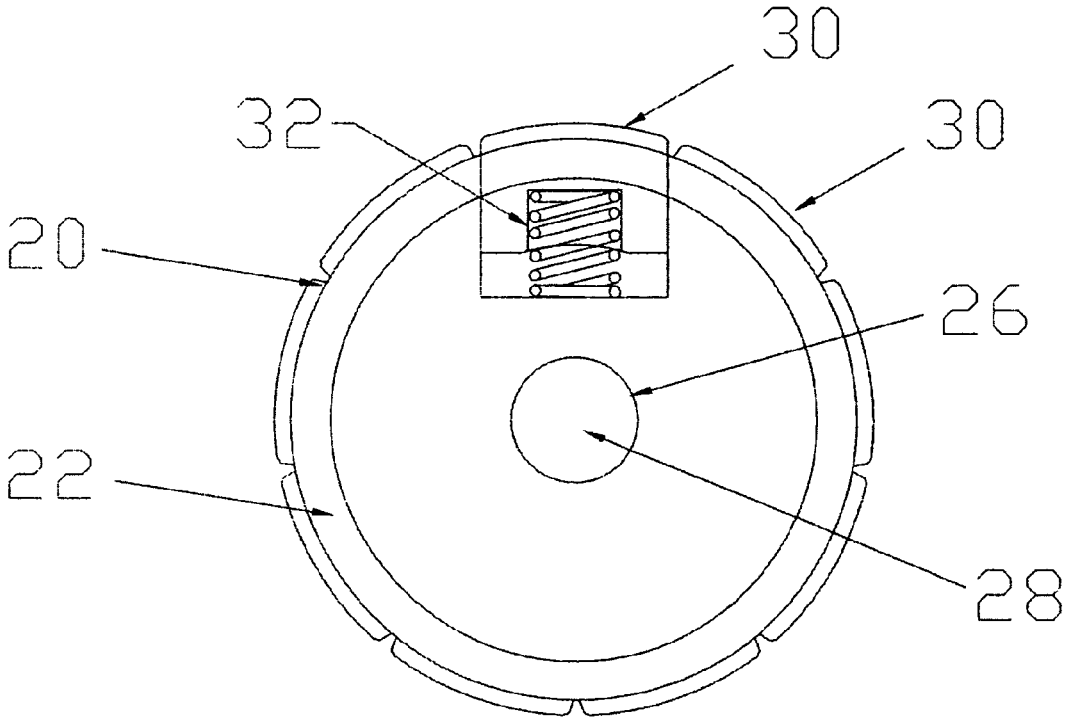
FIG. 3 is an end elevation view, in section, of the rotary scraper, illustrated in FIG. 2.

It will be appreciated to persons skilled in the art that rotary scraper 20 can be made in a number of configurations. The configuration illustrated in FIGS. 2 and 3, is not the only workable configuration. Referring to FIG. 2, rotary scraper 20 has a tubular body 22. Body 22 has an exterior surface 24 and an interior surface 26. Interior surface 26 defines a central mud flow bore 28. A plurality of scraper blades 30 extend from exterior surface 24. Biasing springs 32 underlie scraper blades 30 to force scraper blades 30 radially outwardly from body 22.

Operation:

In operation, motor section 102 rotates rotary scraper 20 along with drill bit 110. This results in rotary scraper 20 scraping debris from interior casing walls. Upon rotation of rotary scraper 20, the scraping is performed by scraper blades 30, which extend from exterior surface 24 of body 22. Biasing springs 32, which underlie scraper blades 30, force scraper blades 30 radially outwardly from body 22 to engage the interior casing walls.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A method of avoiding the need for a scraper run during hydrocarbon well cement drill out operations, comprising:

providing a down hole drilling motor assembly comprising:

a rotary scraper having a first end, a second end and spring biased outwardly extending scraper blades, the scraper blades being positioned at a common angle from an axis of the drilling motor with a radial component that is less than an axial component;

a drill bit secured to the first end of the rotary scraper;

a moineau drilling motor indirectly coupled to the second end of the rotary scraper via a drive shaft and bearing assembly which convert eccentric motion of the moineau drilling motor to concentric motion, the moineau drilling motor rotating the rotary scraper together with the drill bit;

attaching the down hole drilling motor assembly to a drill string and inserting the drill string into casing of a hydrocarbon well until further insertion of the drill string is prevented by cement;

drilling out the cement with the drill bit by imparting a rotational force via the moineau drilling motor while concurrently scraping cement residue from interior walls of the casing with the rotary scraper.

* * * * *